US005473422A

United States Patent [19]

Anzai

[11] Patent Number: 5,473,422

[45] Date of Patent: Dec. 5, 1995

[54] COLOR IMAGE FORMING DEVICE

[75] Inventor: Masayasu Anzai, Ibaraki, Japan

[73] Assignee: Hitachi Koki Co., Ltd., Tokyo, Japan

[21] Appl. No.: 339,159

[22] Filed: Nov. 10, 1994

[30] Foreign Application Priority Data

Nov. 12, 1993 [JP] Japan ..... 5-283522

[51] Int. Cl.[6] ..... G03G 15/01; G03G 21/20

[52] U.S. Cl. ..... 355/327; 355/246; 347/115

[58] Field of Search ..... 355/326 R, 327, 355/246, 30; 430/42, 44, 100; 347/115

[56] References Cited

U.S. PATENT DOCUMENTS

| | | | |
|---|---|---|---|
| 4,078,929 | 3/1978 | Gundlach | 96/1.2 |
| 5,063,127 | 11/1991 | Oka et al. | 355/326 |
| 5,194,351 | 3/1993 | Roller | 430/44 |
| 5,194,905 | 3/1993 | Brewington | 355/326 R |
| 5,260,752 | 11/1993 | Fuma et al. | 355/326 R |
| 5,305,069 | 4/1994 | Nakano | 355/326 R |
| 5,337,136 | 8/1994 | Knapp et al. | 355/326 R |
| 5,347,345 | 9/1994 | Osterhoudt | 355/246 |

FOREIGN PATENT DOCUMENTS

| | | |
|---|---|---|
| 55-83070 | 6/1980 | Japan . |
| 2302768 | 12/1990 | Japan . |
| 318182 | 3/1991 | Japan . |

*Primary Examiner*—R. L. Moses

*Attorney, Agent, or Firm*—Sughrue, Mion, Zinn, Macpeak & Seas

[57] ABSTRACT

A light conductive photosensitive member belt is charged uniformly by use of a charger and an electric charge latent image having three values is formed by means of a laser beam light $L_1$. After then, after the passage of time $t_1$, a yellow developing device is used to develop yellow and, after the passage of time $t_2$, a magenta developing device is used to develop magenta. Next, the photosensitive member belt is recharged by a recharger and another latent image having three values is formed by means of a laser beam light $L_2$. After then, after the passage of time $t_1$, a cyan developing device is used to develop cyan and, after the passage of time $t_2$, a black developing device is used to develop black. Then, these four color toner images are transferred to recording paper.

6 Claims, 5 Drawing Sheets

COLOR IMAGE FORMING DEVICE

BACKGROUND OF THE INVENTION

1. Field of the Invention

The present invention relates to a color image forming device which forms a multi-color image by use of an electrophotography technique.

2. Description of the Related Art

Conventionally, there are known several color image forming devices of a type that forms multi-color images by use of an electrophotography technique: for example, as disclosed in Japanese Patent Examined Publication No. Hei 3-18182, a color image forming device which forms color toner images by colors one by one sequentially on a light conductive photosensitive member and transfers the color toner images onto recording paper or the like; as disclosed in Japanese Patent Unexamined Publication No. 2-302768, a color image forming device which forms a one-color toner image on a light conductive photosensitive member and transfers the one-color toner image onto recording paper or the like, and the process of formation and transfer of the one-color toner image is repeated to thereby form multi-color images; and, as disclosed in U.S. Pat. No. 4,078,929 or in Japanese Patent Unexamined Publication No. 55-83070, color image forming devices each of which forms two-color toner images on a light conductive photosensitive member and then transfers the two-color toner images onto recording paper or the like.

In the first and second color image forming methods employed in the above-mentioned conventional color image forming devices, since the toner image forming step must be repeated a number of times corresponding to the number of colors of the toner, it takes much time to obtain a final color print.

In the third conventional color image forming method, since two kinds of electric charge latent images (three-value latent images) are formed at a time on the light conductive photosensitive member and they are developed by use of two kinds of color toners, the time necessary for forming images can be reduced. When there is used, as the photosensitive member, an organic light conductive photosensitive member or an $As_2Se_3$ photosensitive member which takes 0.2 to 1 sec. as the time (the light response time) in which the electric charge after exposure of the light image is attenuated, there has been a limit to increase in the image forming speed and to reduction of the size of the image forming device. Also, since the respective toner images are not superimposed on one another, the color reproduction range of the composite color is narrowed. Further, because the two kinds of latent images are sequentially developed with two kinds of developers, when the latent images are developed by the second developer, the toner image developed by the first developer can be possibly shaved off. And, in the second development, it is difficult to obtain a sufficient image density. These make it difficult to obtain a multi-color image of high quality.

SUMMARY OF THE INVENTION

Accordingly, it is an object of the invention to provide a color image forming device which is improved in the image forming speed and also in the size reduction thereof. It is another object of the invention to provide a color image forming device which can offer a good color reproducibility of the composite color and also can obtain a sufficient image density.

In attaining the above-mentioned objects, according to the invention, there is provided a color image forming device in which a first developing device is positioned such that the time necessary for a light conductive photosensitive member to move from the light image exposure thereof to the developing area of the first developing device is longer than the time necessary for the surface voltage of the light conductive photosensitive member after the light image exposure thereof to be attenuated down to a value lower than a bias voltage applied to the first developer; and a second developing device is positioned such that the time necessary for the light conductive photosensitive member to move from the light image exposure thereof to the developing area of the second developing device is longer than the time for the surface voltage of the light conductive photosensitive member after the light image exposure thereof to be attenuated down to a value in the neighborhood of the saturation residual voltage of the light conductive photosensitive member.

Also, in attaining the above objects, according to the invention, there is provided a color image forming device in which, in the light image exposure, the phases of the respective unit latent images of the respective colors can be in the scanning direction thereof or in the direction perpendicular to the scanning direction can be shifted about one half.

Further, in attaining the above objects, according to the invention, there is provided a color image forming device in which a developer brush used in developing can be made soft, the direction of rotation of a developing roll can be set in the same direction as the direction of rotation of a light conductive photosensitive member, and the moving speed of the developing roll can be set to be 0.7 to 1.3 times the moving speed of the light conductive photosensitive member.

According to the color image forming device of the invention structured in the above-mentioned manner, since the distance from the light image exposure position to the developing device can be set to be a minimum, there can be obtained a multi-color image forming device which has no wasteful space and is small in size. Also, since the composite color ranges of the respective toner images are so expanded as to be able to realize high image density development, there can be obtained a multi-color print of high quality. The above and other objects and features of the present invention will be more apparent from the following description taken in conjunction with the accompanying drawings.

BRIEF DESCRIPTION OF THE INVENTION

Figure 3A:
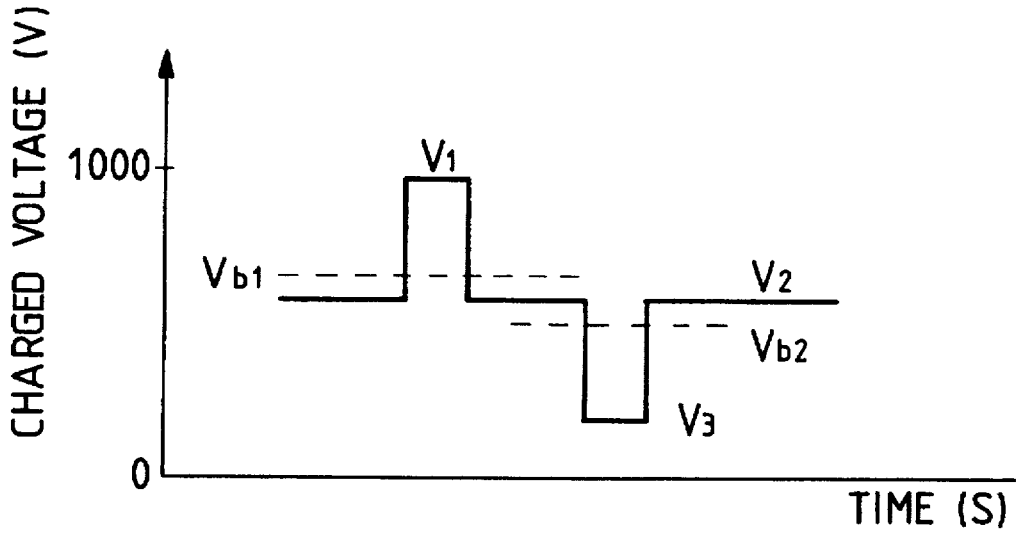
Figure 3B:
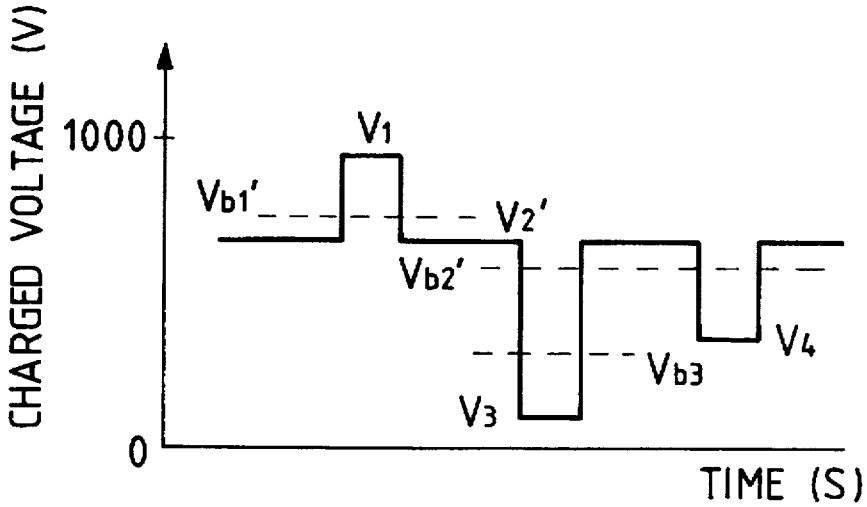
Figure 4A:
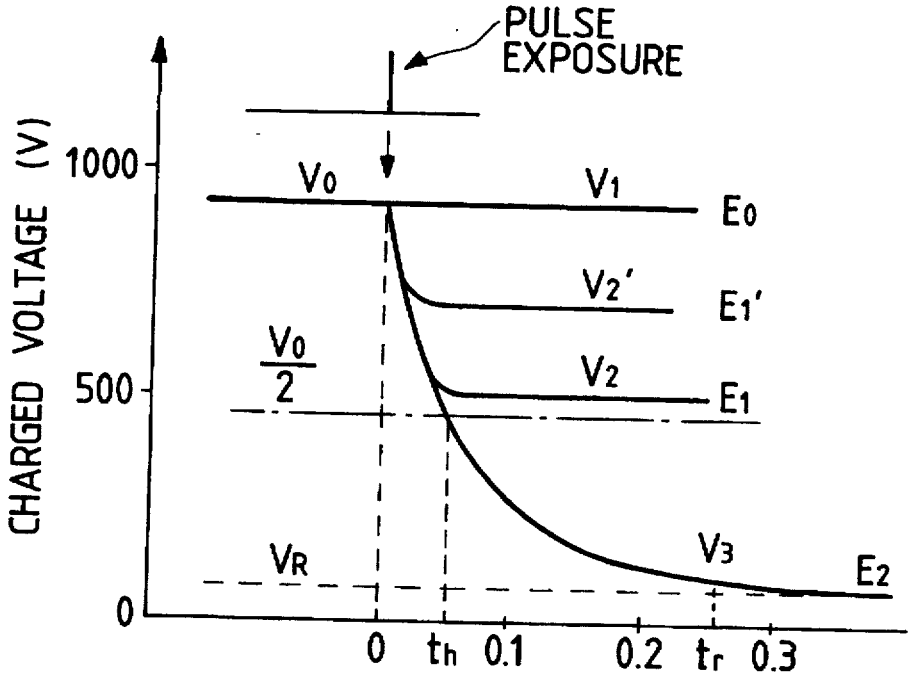
Figure 4B:
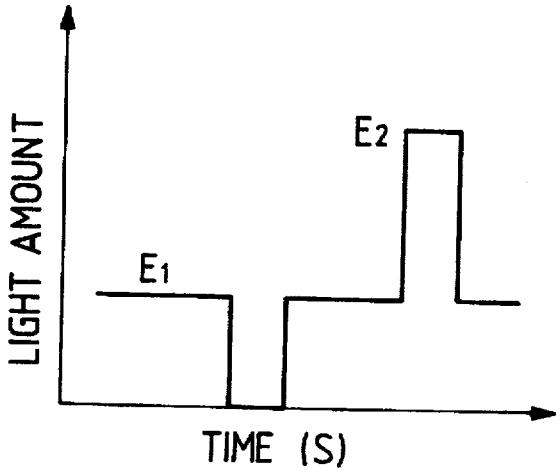
Figure 5A:
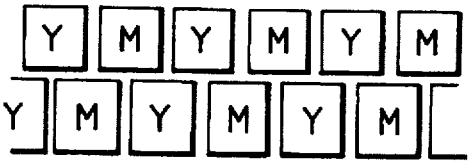
Figure 5B:
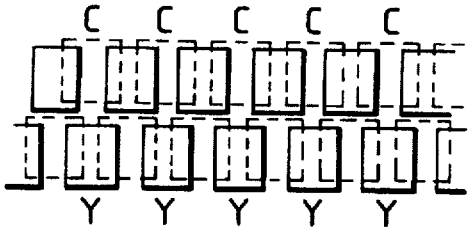
Figure 5C:
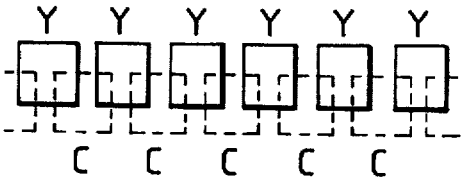
Figure 5D:
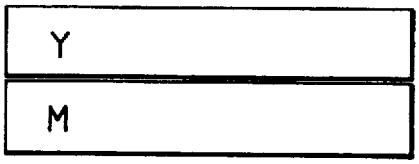
Figure 6:
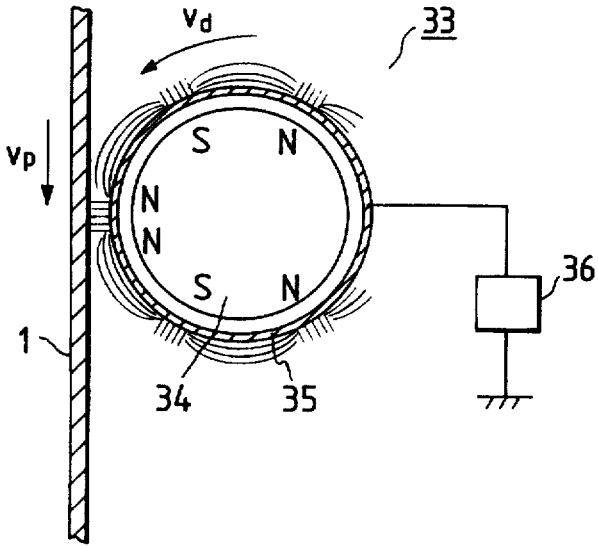
Figure 7:
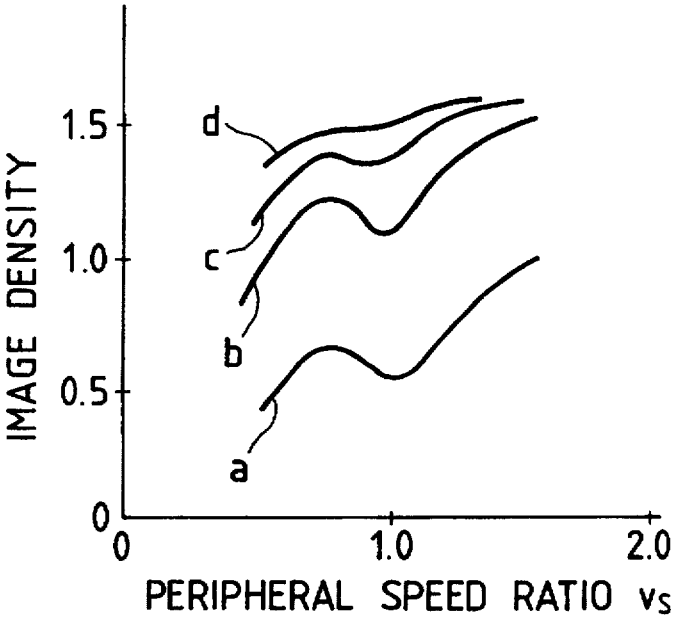
Figure 8:
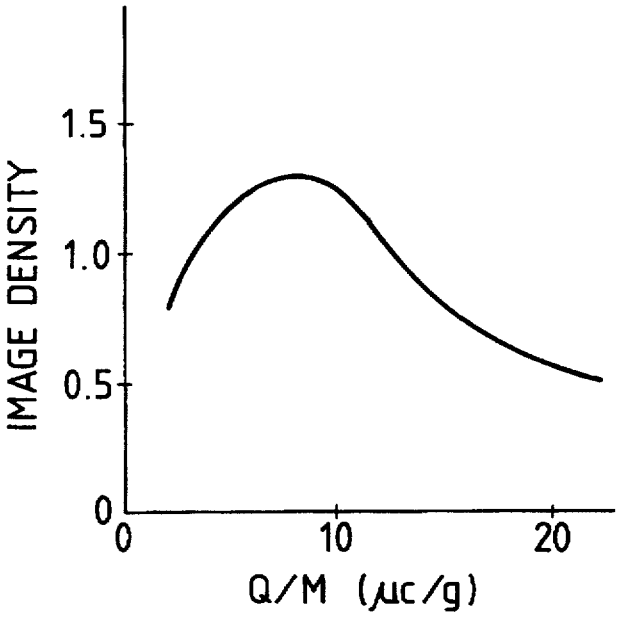

FIGS. 3(*a*) and 3(*b*) are explanatory views showing a method of forming a latent image according to the invention;

FIGS. 4(*a*) and 4(*b*) are explanatory views showing a method of forming a latent image according to the invention;

FIGS. 5(*a*) to 5(*d*) are typical views showing the latent images of the respective colors according to the invention;

FIG. 6 is a typical view of a developing method according to the invention;

FIG. 7 is a graphical representation of a developing characteristic obtained in the developing method shown in FIG. 6; and FIG. 8 is a graphical representation of a developing characteristic obtained in the developing method shown in FIG. 6.

DETAILED DESCRIPTION OF THE PREFERRED EMBODIMENTS

Now, description will be given below of the embodiments of a color image forming device according to the invention with reference to the accompanying drawings.

Figure 1:
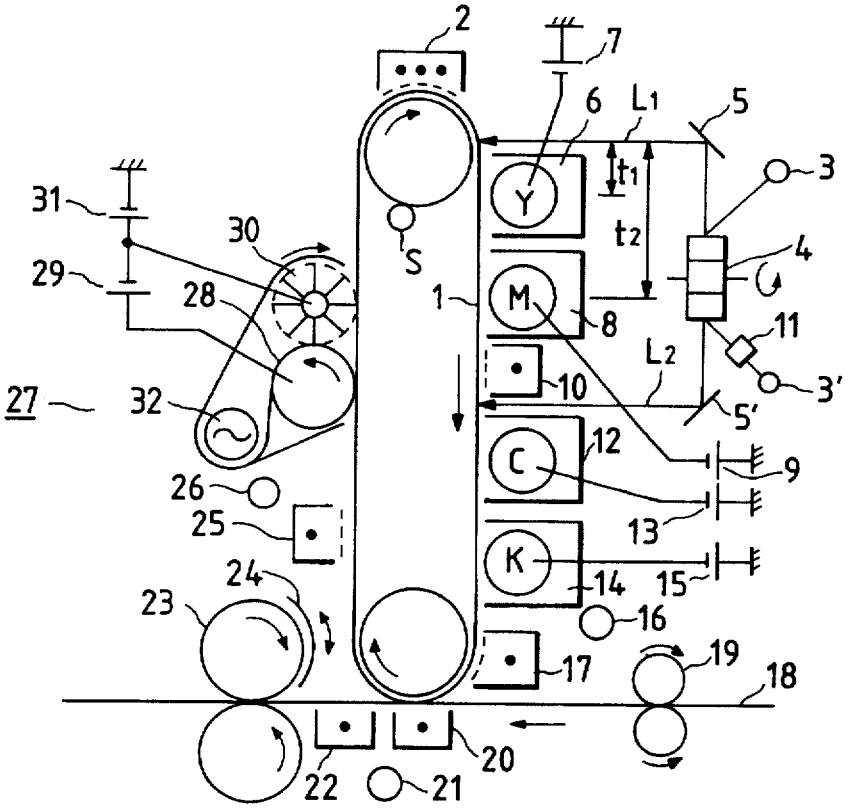
FIG. 1 is a typical view showing a color image forming device according to an embodiment of the invention.

FIG. 1 is a typical view showing a color image forming device according to an embodiment of the invention. Description will be given below of the image forming process of this embodiment.

At first, a light conductive photosensitive member belt 1 (hereinafter referred to as "photosensitive member belt 1") is charged uniformly by a charger 2. Next, a beam that is emitted from a laser 3 is modulated by the color information to be recorded, and the photosensitive member belt 1 is scanned for exposure by the thus modulated laser beam light $L_1$ through a polygonal mirror 4 and a mirror 5 which are rotating. In the exposure steps, as will be described later, three-value electric charge latent images are formed on the photosensitive member belt 1. Then, after the passage of time of $t_1$ from the exposure, the first toner image (yellow) is developed by a yellow developing device (Y) 6. That is, the time necessary for the photosensitive member belt 1 to move from the exposure thereof to the developing area of the yellow developing device 6 is set for $t_1$. At that time, a yellow bias power source 7 is connected to the yellow developing device 6 and an electric charge latent image having a value greater than a bias voltage to be given by the yellow bias power source 7 is developed. That is, normal development is achieved by a colored toner (yellow) having an electric charge of the opposite polarity to the electric charge latent image. In the description of the embodiment of the invention, the charged polarity of the photosensitive member belt 1 is assumed to be negative. Therefore, latent images and charged voltages shown in FIGS. 3 and 4 (which will be described later) are also of negative polarity.

Next, the second color toner image (magenta) is developed by a magenta developing device (M) 8 to which is connected a magenta bias power source 9. At that time, the time necessary for the photosensitive member belt 1 to move from the exposure by the laser beam light $L_1$ to the developing area of the magenta developing device 8 is set for $t_2$ and, as an electric charge latent image, there is developed a latent image which has a value smaller than a bias voltage to be given by the magenta vias power source 9. That is, the latent image is inversely developed by a colored toner (magenta) having an electric charge of the same polarity as the electric charge latent image.

Next, the photosensitive member belt 1 is charged again by a recharger 10. After then, the beam that is emitted from a laser 3+ is modulated by another color information, and the photosensitive member belt 1 is scanned by the modulated laser beam light $L_2$ through the polygonal mirror 4 and a mirror 5' which are rotating to thereby form a three-value electric charge latent image. In this operation, as will be described later, the position of the record image of the laser beam light $L_2$ in the sub-scanning direction thereof (the direction perpendicular to the scanning direction thereof) is adjusted by a deflecting device 11. As the deflecting device 11, there can be used a galvanomirror, an electric deflecting mirror, an opto-acoustic element or the like. Also, if a light emission position varying laser element or the like is used as the laser 3', then the deflecting device 11 can be omitted.

Next, the third color toner (cyan) is developed by a developing device (C) 12 to which is connected a cyan bias power source 13. In this development, the time for the photosensitive member belt 1 to move from the exposure thereof by the laser beam light $L_2$ to the developing area of the cyan developing device 12, similarly to the above yellow developing device, is set for $t_1$. An electric charge latent image having a value greater than a bias voltage to be given by the cyan bias power source 13 is normally developed by a colored toner (cyan) which has an electric charge of the opposite polarity to the latent image.

After then, the fourth color toner image (black) is developed by a black developing device (K) 14 to which is connected a black bias power source 15. In this development, the time for the photosensitive member belt 1 to move from the exposure thereof by the laser beam light $L_2$ to the developing area of the black developing device 14, similarly to the above-mentioned magenta developing device, is set for $t_2$. And, a latent image having a value smaller than a bias voltage to be given by the black bias power source 15 is inversely developed by a colored toner (black) which has an electric charge of the same polarity as the latent image.

Then, a fade lamp 16 is used to irradiate a uniform light onto the surface of the photosensitive member belt 1 to thereby attenuate the electric charge on the surface of the belt 1. After then, the photosensitive member belt 1 is charged by an ante-transfer charger 17, and the charged polarities of the respective color toner images developed on the photosensitive member belt 1 are arranged to the same polarity, preparing for the transfer operation of the toner images which will be performed in the next step. Although the light irradiation by the fade lamp 16 can be omitted, use of the light irradiation by the fade lamp 16 is preferable not only in prevention of overcharging of the photosensitive member belt 1 but also in arrangement of the charged polarities and the amounts of charging of the toners.

Next, recording paper 18 is drawn out in timing by a resist roller 19, is brought into contact with the photosensitive member belt 1, and is then moved in synchronization with the belt. At that time, electric charges of the opposite polarity to the electric charges of the toner are given onto the back surface of the recording paper 18, and the respective toner images are transferred to the recording paper 18 due to the electric field action of the electric charges given to the back surface of the recording paper 18. An electricity removing lamp 21 irradiates the photosensitive member belt 1 in the neighborhood of the leading end portion of the recording paper 18 to reduce an electrostatic absorbing force between the photosensitive member belt 1 and recording paper 18 so as to facilitate the separation of the recording paper 18. An electricity removing device 22 gives an a.c. corona to the back surface of the recording paper 18 so as not only to separate the recording paper 18 smoothly but also to prevent the toner images from being deformed when they are transferred. After the color toner images are transferred to the recording paper 18, the toner images are fixed by a thermally fixing roller 23, that is, due to the action of the heat and pressure of the fixing roller 23 to thereby be able to obtain a color print finally.

The toners remaining on the photosensitive member belt 1 after the toner images are transferred to the recording paper 18 are charged again by an ante-cleaning charger 25. At that time, the electric charges used to charge the photosensitive member belt 1 are attenuated by an ante-cleaning lamp 26 and are then cleaned by a cleaner 27. The cleaner 27 includes a collect roller 28 (approachable or contactable with the photosensitive member belt 1), to which is applied a voltage of the opposite polarity to the remaining toners by a collect bias power source 29 and a cleaner brush 30 (contactable with the photosensitive member belt 1), to which is applied a voltage of the opposite polarity to the remaining toners by a brush bias power source 31. Thus, the remaining toners are scratched and removed in an electrostatic absorbing manner or mechanically by the cleaner brush 30 and the collect roller 28 off the photosensitive member belt 1. The toners that are stuck to the cleaner brush 30 are transferred to the collect roller 28 with a higher voltage applied thereto. And, the toners that are absorbed or adhered to the collect roller 28 are scratched by a blade, and is delivered and collected by use of a collect screw 32.

The latent image forming characteristics of the photosensitive member belt 1 such as the sensitivity, the light response after exposure, the residual voltage characteristic of the belt 1 may depend on the temperature of the photosensitive member belt 1. Especially, when the organic light conductive photosensitive member or an $As_2Se_3$ photosensitive member is used, at low temperatures of 10° C. or lower, the light response speed is slow and the residual voltage tends to increase. In order to minimize these influences of the temperature, it is desirable to use the photosensitive member belt 1 at a temperature of 10° C. or higher. In a structure shown in FIG. 1, the heat of the thermally fixing roller 23 is used to solve this problem. The surface temperature of the thermally fixing roller 23 is normally in the range of 150° to 200° C. while the roller 23 is in operation. However, an adiabatic plate 24 provided on the photosensitive member belt 1 side of the thermally fixing roller 23 is so arranged as to be movable, and the temperature of the photosensitive member belt 1 is measured indirectly by a temperature sensor S which detects the temperature of the roller for driving the photosensitive member belt 1 to thereby control the opening and closing of the adiabatic plate 24. For example, when the temperature is of 10° C. or lower, the adiabatic plate 24 is opened to heat the photosensitive member belt 1 due to heat generated from the thermally fixing roller 23.

Figure 2:
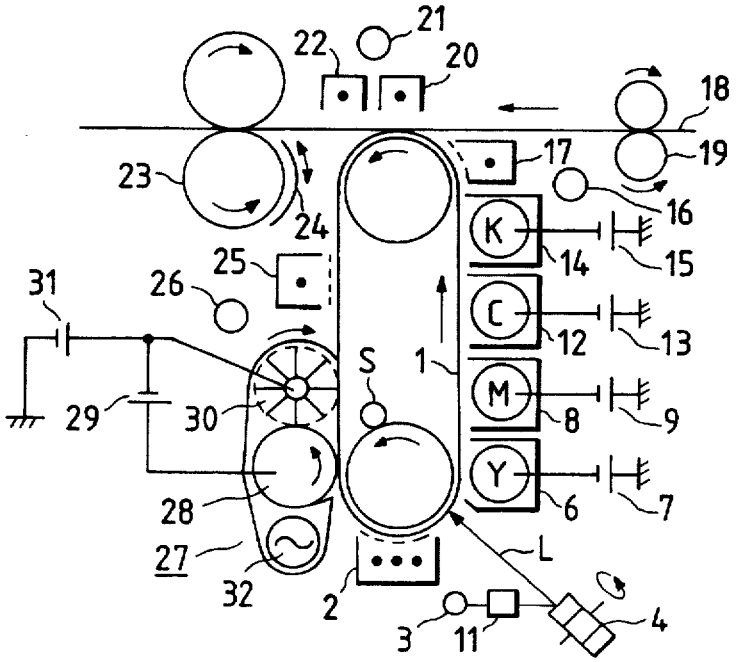
FIG. 2 is a typical view showing a color image forming device according to another embodiment of the invention.

FIG. 2 is a typical view showing a color image forming device according to another embodiment of the invention.

In this embodiment, a full color toner image can be formed when the photosensitive member belt 1 is rotated two times. From now on, description will be given of an image forming process according to this embodiment. At first, by means of the first rotation of the photosensitive member belt 1, the charger 2, laser beam light $L_3$, yellow developing device 6 and magenta developing device 8 are operated to thereby form yellow and magenta toner images on the belt 1. Next, by means of the second rotation of the photosensitive member belt 1, the charger 2, laser beam light $L_3$, cyan developing device 12 and black developing device 14 are operated to thereby form cyan and black toner images on the belt 1 in such a manner that they correspond in position to the previously formed yellow and magenta toner images. These four color toner images are electrically charged by the ante-transfer charger 17 and, after the charged polarities of the toners are arranged, the toner images are transferred to the recording paper 18 to thereby obtain a full color image.

The residual toners that remain on the photosensitive member belt 1 after the above transfer can be removed by means of operation of the ante-cleaning charger 25, ante-cleaning lamp 26 and cleaner 27. Referring to the operation of the cleaner 27, unlike the operation of the cleaner shown in FIG. 1, the residual toners on the photosensitive member belt 1 are firstly cleaned by use of the cleaner brush 30 and, after then, they are further cleaned by the collect roller 28 which has been made to approach or come into contact with the belt 1. The toners stuck to the cleaner brush 30 are then moved to the collect roller 28. In the structure shown in FIG. 2 as well, similarly to the cleaner shown in FIG. 1, the collect roller 28 serves not only as a cleaner but also as a seal which prevents the toners from dropping down or flying away from the cleaner brush 30.

FIGS. 3(*a*) and 3(*b*) are typical views showing the distribution of the charged voltage of the surface of the photosensitive member produced by electric charge latent images formed when the photosensitive member is exposed for light images by use of the devices respectively having the structures shown in FIGS. 1 and 2.

In particular, FIG. 3(*a*) shows the distribution of the charged voltage produced when the charged voltage is divided almost into two halves and electric charge latent images each having three values and also having two kinds of information is formed. In FIGS. 3(*a*) and 3(*b*), reference character $V_1$ designates a voltage which corresponds to a charged voltage produced when the photosensitive member belt 1 is charged by the charger 2. $V_2$ designates a charged voltage produced in a portion of the belt 1 which is to be exposed by use of an intermediate amount of light, and $V_3$ stands for a charged voltage produced in a portion of the belt 1 which is to be exposed by use of a sufficient amount of light. $V_1$ and $V_3$ respectively correspond to the respective pieces of information to be recorded, while $V_2$ corresponds to the background portion of the image. Here, if a bias voltage $V_{b1}$ is applied to a developing device for a first color and development is executed by use of a toner having electric charges of the opposite polarity to the charged voltage, then the first color toner is stuck to an electric charge latent image having a size of $V_1$-$V_{b1}$, so that a toner image of the first color can be formed. Next, if a bias voltage $V_{b2}$ is applied to a developing device for a second color and development is executed by use of a developing device having an electric charge of the same polarity as the charged voltage, then the second color toner is stuck to an electric charge latent image having a size of $V_3$-$V_{b2}$, so that the second color toner image can be formed. In this manner, there can be developed on the photosensitive member the two color toner images which respectively correspond to the two kinds of information.

Now, FIG. 3(*b*) shows the distribution of a charged voltage produced when electric charge latent images having four values and also having three pieces of information are formed. Similarly to FIG. 3 (*a*), the first color toner image is formed on an electric charge latent image having a size of $V_1$-$V_{b1}$, and next the second color toner image is formed on an electric charge latent image having a size of $V_3$-$V_{b3}$. After then, the third color toner images are formed on electric charge latent images respectively having sizes of $V_4$-$V_{b2}$, and $V_3$-$V_{b2'}$.

Now, FIGS. 4(*a*) and 4(*b*) show how the electric charge latent image is formed with the passage of time. In FIGS. 4(*a*) and 4(*b*), as a photosensitive member, there is used an organic photosensitive member of a two layer type. To form the organic photosensitive member, aluminum is evaporated on a film having a thickness of 150 μm and including polyester as the base thereof to thereby form a conductive layer, and an electric charge generation layer (having a thickness of the order of 0.1 μm) formed of titanyl-phthalocyanine and silicone resin and an electric charge transfer layer (having a thickness of the order of 20 μm) formed of hydrazone and polycarbonate resin are respectively put on the conductive layer.

In particular, FIG. 4(*a*) shows the potential attenuation (light response) with the passage of time occurring when, after the organic photosensitive member is charged to a charged voltage $V_0$ (950 V), the photosensitive member is pulse exposed (for a period of time of the order of $10^{-7}$ sec.) by means of laser beam scanning. In this pulse exposure, the amount of light is varied in the order of $E_0$=0, $E_1$=2 mJ/m$^2$, $E_1$=4 mJ/m$^2$, and $E_2$=15 mJ/m$^2$. When the amount of light is $E_l$, the charged voltage provides about ½ of $V_0$ and time required for this is of the order of 0.05 sec. In FIG. 4(*a*), reference character $t_h$ stands for the time that is necessary for the charged voltage to reach $V_0/2$ when such an amount of light is given to the photosensitive member that can produce a charged voltage of $V_0/2$. On the other hand, when $E_2$ is given, then $t_r$÷0.25 sec. is necessary in order to obtain $V_3$÷80 V, and further about 0.4 sec. is required to reach a saturation residual voltage $V_R$. Now, FIG. 4(*b*) shows waveforms of amounts of light when the photosensitive member is exposed by use of a laser beam.

If three-value latent images are developed after they are formed, when a voltage after light image exposure is small to a sufficient degree and variations in the voltage are as small as possible, then there can be obtained not only a large latent image voltage necessary for development but also a stable image. For example, in order to satisfy a condition that the charged voltage after exposure becomes $V_3$ or smaller, it is necessary to secure a time of the order of 0.25 sec. until a latent image is formed. In particular, if a color image forming device is structured such that it can secure a time of 0.25 sec. or longer as the time necessary for the photosensitive member to move from the exposure position thereof to the developing area of a developing device, then the distance between the exposure position and the developing device is 75 mm when the moving speed of the photosensitive member is 300 mm/sec. For this reason, in FIG. 1, if a set of developing devices (that is, the yellow developing device 6 and magenta developing device 8), which are used to develop the latent images formed by exposure after the light image exposure by means of the later beam light $L_1$, are positioned at a position corresponding to the passage of time of 0.25 sec., then a space corresponding to a distance of 75 mm must be secured and thus the length of the photosensitive member belt 1 must also be extended by a length corresponding to the space. This can also apply to the developing devices to be used after the exposure by the laser beam light $L_2$. This increases the size of the whole device.

On the other hand, in the color image forming device according to the invention, as described before in connection with FIGS. 3(*a*) and 3(*b*), the latent image having three or more values is formed. At first, a first latent image is normally developed with a first colored toner before a second latent image is completely formed and subsequently the second latent image which has been completely formed is reversely developed with a second colored toner. For example, when forming the latent image of FIG. 3 (*a*), the time necessary for formation of the charged voltage $V_2$ is of the order of 0.05 sec. as shown in FIG. 4(*a*), and the toner image of the first color is formed by use of $V_1$-$V_{b1}$. Therefore, development may be executed after the passage of time of 0.05 sec. after the light image exposure. According to the invention, after the light image exposure for forming three or more values is executed on the photosensitive member, the time necessary for the photosensitive member to reach the developing device of the first color is set between the time necessary for the charged voltage to reach a value smaller than the bias voltage ($V_{b1}$) applied to the developing device of the first color and the time necessary to reach a value in the neighborhood of the saturation residual voltage ($V_R$), thereby reducing the size of the whole device. In particular, in the above-mentioned embodiment, the time necessary to reach the developing area of the first color developing device is set in the range of 0.05 to 0.25 sec., while the time necessary to reach the developing device of the second color is set for about 0.25 sec. or longer.

That is, in FIG. 1, $t_1$ is set in the range of 0.05 to 0.25 sec., and $t_2$ is set for about 0.25 sec. or longer. Due to this, even if a photosensitive member having a light response time $t_r$ which is relatively large is used, it is possible to produce a compact color image forming device.

In this case, as shown in FIG. 1, it is desirable that the brightness of the first development toner is higher than that of the second development toner. This is because in the case of previously developing the color high in brightness, even though fog occurs by attaching toner thereto when voltage $V_{b1}$-$V_2$ is small with respect to the background portion, the fog is inconspicuous, and also because the influence of mixed colors is reduced when the first toner is inserted into the second color developing device. According to the above-mentioned structure, since it is possible to reduce the time $t_1$ necessary for the photosensitive member to move from the light image exposure thereof to the developing area of the first developing device, that is, since it is not necessary to provide a space extending from the exposure position of the photosensitive member to the position of the first developing device to thereby save a wasteful space, the color image forming device can be made compact and the image forming speed of the color image forming device can be increased. For example, even if an ordinary two-layer type organic light conductive member (light response time of 0.3 to 0.5 sec.) is used as a photosensitive member, $t_1$÷0.05 sec. can be obtained. For this reason, even if the moving speed of the photosensitive member belt 1 is a high speed of 300 mm/s, the distance from the exposure position thereof by the laser beam light $L_1$ to the contact position between the developing roll of the developing device and the photosensitive member belt 1 can be set for 15 mm. This makes it possible to provide a small-size developing device using a small-diameter developing roll at a position close to the exposure position. Also, by applying an exposure method to be described later in connection with FIGS. 5(*a*) to 5(*d*) and a developing method to be described later in connection with FIGS. 6 to 8, the composite and mixed colors of the respective color toner images can be produced in an excellent manner, so that a full color print excellent in color reproducibility can be obtained.

In the color image forming device having the structure shown in FIG. 1, as shown in FIGS. 3(*a*) and 3(*b*), at the first light image exposure, the electric charge latent images corresponding to the two pieces of image information are formed in parallel to each other on the photosensitive member. Also, at the second light image exposure, the electric charge latent images are exposed to the light or are toner developed in such a manner that they are superimposed on top of each other. Therefore, when the composite color is exposed to the light, it is preferable to employ a method to be described below.

Now, FIGS. 5(*a*) to 5(*d*) are typical views showing latent images respectively corresponding to the respective toner images, that is, the respective light image exposure conditions.

In particular, FIG. 5(*a*) shows an embodiment in which the composite color of yellow (Y) and magenta (M) is reproduced by means of latent images formed by a light image exposure method according to the invention. Areas marked by Y and M respectively represent the minimum recording unit (dot) of the respective colors. At first, within the first scanning line, latent images corresponding to the respective colors are formed alternately, like Y, M, Y, M - - - . That is, for a single scanning line, the latent images are formed in this manner. On the other hand, when YM colors are reproduced for a plurality of scanning lines, as shown in FIG. 5(*a*), the phase of the dots on the second scanning line is shifted by ½ dots from the first scanning line. In doing so, the respective color dots, after exposed, are able to reproduce colors which are mixed more uniformly in a visual sense. Also, after developed, the toners are strongly adhered onto the photosensitive member, thereby being able to prevent the toners from being scratched off in the following developing operations. If the composite color is YC which consists of yellow (Y) and cyan (C), in FIG. 1, a Y toner image is formed in the first image forming step after the exposure by the laser beam light $L_1$, and a C toner image is formed at a position M shown in FIG. 5(*a*) in the second image forming step after the exposure by the laser beam light $L_2$. If the composite color is MC consisting of magenta (M) and cyan (C), similarly, a C toner image may be formed at a position Y shown in FIG. 5(*a*).

When the composite color is produced in such a manner that one toner image is formed in the first image forming step like YC and the other toner image is formed in the second image forming step, it is preferable to employ methods respectively shown in FIGS. 5(*b*) and 5(*c*). Solid lines represent a Y color which is formed in the first image forming step, while broken lines express a C color which is formed in the second image forming step. In FIG. 5 (*b*), at first, the Y color is formed by making the respective dots be independent of one another and shifting the phases between mutually adjoining scanning lines from each other by ½ dots, and next, in the second image forming step, the C color is formed by overlapping the dots of Y and C on each other in such a manner that the phases of the Y and C dots are shifted from each other by ½ dots in the horizontal scanning direction. In doing so, in the second light image exposure as well, the C latent images can be formed without being distorted between the Y color dots in spite of the existence of the Y color toners and, in development as well, the C color toner images can be developed without the previous color, namely, Y color being scratched off so much. Therefore, there can be obtained a color print which is excellent in color reproducibility.

In FIG. 5 (*c*), the phases of dots are shifted by ½ dots not only in the horizontal scanning direction but also in perpendicular scanning direction, thereby being able to obtain a color image which is further excellent in color reproducibility. In these image forming operations according to FIGS. 5(*a*) to 5(*c*), as in the embodiment shown in FIGS. 1 and 2, it is preferable that Y and M are combined with each other in the first image forming step and C and K are combined with each other in the second image forming step. This is partly because, when a laser having an oscillation wavelength in the range of 630 to 750 nm is used, the light transmittances of the Y and M toners in the first image forming step are good in the above mentioned wavelength area and thus the Y and M toners do not impede the exposure so much, and partly because, even if the toners formed in the first image forming step are mixed into a developing device to be used in the second image forming step, since the lightnesses of the colors become gradually lower sequentially, the mixed toners are not noticeable.

In FIG. 5(*d*), there is shown an embodiment which is different from the embodiments respectively shown in FIGS. 5(*a*), 5(*b*) and 5(*c*). That is, in FIG. 5(*d*), a composite color is obtained without making the respective colors be independent of one another by the minimum dot unit thereof or without shifting the phases of the respective colors from one each other. In this case, the colors are difficult to be mixed with each other in a small area, so that a color print obtained in this manner is poor in color reproducibility.

As described above, according to the invention, the areas of the respective colors are divided into small dots and mutually adjoining dots are shifted in phase from each other, thereby be able to improve the color reproducibility of a color print. In the description of FIGS. 5(*a*) to 5(*d*), the size of the minimum dot in the horizontal scanning direction is almost equal to that in the perpendicular scanning direction. However, when the exposure are scanned and exposed by use of a laser beam, the size of the dot in the horizontal scanning direction may be preferably ⅓ to 2 times the size of the dot in the perpendicular scanning direction. And, alternatively, the exposure method in which the respective areas are divided into small dots may be used only in the first image forming step and another method in which the areas are not divided into small dots may be used in the second image forming step.

To shift the phases of the small dots in the scanning direction as described in FIGS. 5(*a*) to 5(*c*), the phases of signals for modulating the laser beam light may be shifted. To shift the phases in the perpendicular scanning direction, the scanning positions of the laser beam lights $L_1$ and $L_2$ may be previously shifted about ½ from each other, or the laser beam light may be deflected when the composite color is recorded by use of the deflecting device 11 shown in FIGS. 1 and 2. The phase shifting operation or the color areas dividing operation may be performed only when the composite color is recorded. Due to this, the recording of the composite color can be judged and separated by use of a color judgment circuit, while the recording of picture information can be separated by use of an image area separation circuit.

FIGS. 6, 7 and 8 are respectively views to explain a developing method which is suitable for the color image forming device shown in FIGS. 1 and 2.

In particular, FIG. 6 is a typical view of an embodiment of a developing method which is suitable for development for the second and following colors (in FIG. 1, development by the magenta, cyan and black developing devices). A developing device 33 includes a fixed magnet 34 provided in a developing roll (having a diameter of 20 to 30 mm) 35. The photosensitive member belt 1 and developing roll 35, as shown by an arrow, move in the same direction at the respective speeds of $V_p$ and $V_d$. A developing bias voltage is applied to the developing roll 35 from a bias power source (an alternating current superposition of 500 Hz to 5 kHz) 36. On the opposing side of a fixed magnet 34 to the photosensitive member belt 1, as a developing magnetic pole, there are provided magnets (having 700 to 1,200 gausses) of the same polarity adjacently to each other (this is referred to as a double-polar magnetic pole).

In the present developing method, there is used a magnetic developer which consists mainly of a magnetic carrier and a non-magnetic colored toner. The magnetic carrier may include a core member and a charging adjustment material coated on the surface of the core member. The core member may be formed of semiconductive core material which has an average particle diameter of 30 to 150 μm, preferably, 50 to 100 μm, saturated magnetization$\sigma_s$=20 to 100 emu/g, preferably, 40 to 80 emu/g, volumetric electric resistance $10^8$ to $10^{14}$ Ωcm (which is measured by putting the material into a vessel in a soft tapping manner, at a voltage of 1,000 V/cm), preferably, $10^{10}$ to $10^{12}$ Ωcm. The volumetric electric resistance of the core member may be almost equal to that of the above material. The most preferable magnetic carrier is a plastic carrier produced in such a manner that a core member thereof (in a spherical or flat shape) is formed of resin such as silicone, polyester or the like and fine particle magnetic powder such as magnetite, ferrite, iron powder or the like dispersed in the resin, and the surface of the core member is coated with insulating or semiconductive resin (acryl, silicone or the like). As the toner, a fine particle toner is preferable which has an average particle diameter of 2 to 10 μm, preferably, 4 to 7 μm. According to the above-mentioned developer and developing device, it is possible to obtain an image which is excellent in color reproducibility and has a large image density, and also there is eliminated the possibility that the previous color toner can be mixed into the developing device. This is because the magnetic brush made of the developing magnetic poles is so soft as to allow even the small diameter roll to achieve high density development.

Now, FIG. 7 shows a graphical representation of an example of a developing characteristic obtained when the second color (magenta) was developed by use of the developing device shown in FIG. 6 in the color image forming device shown in FIG. 1. This experiment was conducted under the condition that $V_p$ =200 mm/s, $V_o$=950 V, $V_r$=100 V, $V_{b1}$=350 V, plastic carrier (average particle diameter of 70 μm, saturated magnetization $\sigma_s$ =60 emu/g, and volumetric electric resistance of $5\times10^{11}$ Ωcm), gap of 0.8 mm between the developing roll and the surface of the photosensitive member belt 1, strength of the developing magnetic pole 1000 gauss, $V_s=V_d/V_p$, toner average particle diameter of 7 μm, and toner density of 15 wt %. A curved line "a" shows a case when the toner average electric charge amount Q/M=18 μc/g and the developing magnetic pole is a unipolar magnetic pole. In this case, the image density was low and, when $V_s$=1, a heavily uneven image was obtained. A curved line "b" shows a case when Q/M=6 μc/g and a unipolar developing magnetic pole is used, while a curved line "c" shows a case when Q/M=6 μc/g and a double-polar developing magnetic pole is used. In the curved line "c", the image density and uniformity were both improved. A curved line "d" shows a case when not only the conditions of the curved line "c" are used but also an a.c. voltage having 1 kHz and an amplitude of 300 V is superimposed on the developing bias voltage. In this case, both the image density and uniformity could be further improved.

Now, FIG. 8 shows a relationship between the average amount of electric charges of a toner and the image density, in which a unipolar developing magnetic pole is used and $V_s$=0.8. From FIGS. 7 and 8, it can be seen that a high image density can be obtained when Q/M is in the range of 5 to 10 μc/g. However, when the electric charge amount is low, since there is a possibility that the toner can fly away out of the developing device, it is preferable that the developing roller speed may be small. Also, in order to make it difficult for the toner image formed in the previous image forming step to be scratched off by the developer in the next image forming step, $V_d/V_p= V_s\div1$ is desirable. These facts tell that, in order to obtain a high image density and to minimize the possibility of the toner flying away, a low electric charge amount toner image is used and $V_s$=0.7 to 1.3 is selected. On the other hand, it is preferable that the electric charge amount of the toner for the first color is rather large in order to increase the adhesion force of the toner to the photosensitive member belt 1 and thus to minimize the amount of the toner that can be scratched off in the second color development.

In the above-mentioned embodiments respectively shown in FIGS. 1 and 2, the present invention has been described in accordance with the system in which the four color toner images are formed on the photosensitive member belt 1. However, this is not limitative but the present invention can also be applied to other systems. For example, the present invention can be applied to a system in which two color (for example, Y and M) toner images are formed on the photosensitive member belt 1 in the first image forming step, the toner images are transferred to recording paper, next two color (C and M) toner images are formed in the second image forming step, and the toner images are transferred to the recording paper in such a manner that they correspond in position to the former two color toners.

According to the invention, since there is employed a structure which can reduce the time necessary for the photosensitive member to move from the light image exposure thereof to the developing area of the developing device, a compact color image forming device can be realized.

Also, since the minimum unit latent images of the respective colors are formed independently of one another and the phases of mutually adjoining unit latent images are shifted from each other in the horizontal scanning direction or in the perpendicular scanning direction, it is possible to obtain a color image which provides the excellent color reproducibility of the composite color. Further, because the contact between the developer and photosensitive member is soft and there is employed a developing method which provides a high developing efficiency, it is possible to form a color image which provides a high quality image and a high image density.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A color image forming device for forming a multicolor image, comprising:

a light conductive photosensitive member;

a charger for charging said light conductive photosensitive member;

means for exposing said light conductive photosensitive member according to color information to be recorded to provide multi-level latent images thereon;

first developing means for developing a first latent image by a first colored toner having a polarity opposite to said first latent image;

a first bias power source for applying a first bias voltage to said first developing means, said first latent image having a charged voltage greater than said first bias voltage, said first developing means being positioned so that a time necessary for moving said light conductive photosensitive member from a position for first light image exposure to a position for first development is longer than a time necessary for attenuating a surface voltage of said light conductive photosensitive member after the light image exposure down to a value lower than said first bias voltage applied to said first developing means;

second developing means for developing a second latent image by a second colored toner having a polarity identical with said second latent image;

a second bias power source for applying a second bias voltage to said second developing means, said second latent image having a charged voltage smaller than said second bias voltage, said second developing means being positioned so that a time necessary for moving said light conductive photosensitive member from a position for the light image exposure to a position for second development is longer than a time necessary for attenuating a surface voltage of said light conductive photosensitive member after the light image exposure down to a value in the neighborhood of the saturation residual voltage of said light conductive photosensitive member.

2. A color image forming device as claimed in claim 1, wherein said second developing means comprises a plurality of developing devices and said second bias power source comprises a plurality of bias power sources.

3. A color image forming device as claimed in claim 1, wherein said light conductive photosensitive member is belt-shaped.

4. A color image forming device as claimed in claim 1, further comprising means for controlling a temperature of said light conductive photosensitive member.

5. A color image forming device as claimed in claim 1, wherein the brightness of the first latent image is higher than that of the second latent image.

6. A color image forming device as claimed in claim 1, wherein an image forming process consisting combination of two of colored toners of yellow, magenta, cyan and black are repeated twice to obtain a full-color image.

* * * * *